United States Patent [19]

Kerr

[11] Patent Number: 4,993,002

[45] Date of Patent: Feb. 12, 1991

[54] NAUTICAL MOON AND TIDE CLOCK APPARATUS

[76] Inventor: Breene M. Kerr, 1200 Davinbrook, Oklahoma City, Okla. 73118

[21] Appl. No.: 422,991

[22] Filed: Oct. 16, 1989

[51] Int. Cl.[5] ..... G04B 19/26

[52] U.S. Cl. ..... 368/19; 368/18

[58] Field of Search ..... 368/15–20

[56] References Cited

U.S. PATENT DOCUMENTS

| | | | |
|---|---|---|---|
| 245,130 | 8/1881 | Burmann | 368/18 |
| 463,101 | 11/1891 | Cory | 368/15 |
| 508,467 | 11/1893 | Clark | 368/15 |
| 1,126,214 | 1/1915 | Herschede | 368/18 |
| 1,997,511 | 4/1935 | Canepa | 58/58 |
| 2,437,621 | 3/1948 | Strate | 235/78 |
| 3,721,083 | 3/1973 | Jauch | 58/3 |
| 3,902,309 | 9/1975 | Torrence | 58/3 |
| 4,014,163 | 3/1977 | Wisser | 368/19 |
| 4,435,795 | 3/1984 | Frank | 368/16 |
| 4,623,259 | 11/1986 | Oberst | 368/19 |
| 4,684,260 | 8/1987 | Jackle | 368/16 |
| 4,692,031 | 9/1987 | Kaneko et al. | 368/18 |
| 4,759,002 | 7/1988 | Cash | 368/15 |
| 4,853,908 | 8/1989 | Bourquin et al. | 368/19 |

FOREIGN PATENT DOCUMENTS

| | | | |
|---|---|---|---|
| 2994474 | 5/1981 | Fed. Rep. of Germany | 368/19 |
| 0116287 | 5/1987 | Japan | 368/19 |
| 0263490 | 11/1987 | Japan | 368/19 |
| 0281195 | 6/1952 | Switzerland | 368/19 |

OTHER PUBLICATIONS

A brochure published by Kreiger TM Watch Corp. Entitled, "It's High Time".

An article appearing in The Wall Street Journal Entitled, "New Wave of Watches Tells Tide and Time".

An Advertisement/Brochure Entitled, "Introducing . . . The Tide Watch"-A Unique Tide Forecaster with Graphic Display, Published by Tidewatch Products, Inc.

*Primary Examiner*—Bernard Roskoski

*Attorney, Agent, or Firm*—Laney, Dougherty Hessin & Beavers

[57] ABSTRACT

A moon clock for indicating a phase of the moon. The moon clock comprises a moon disk rotatable about a central axis having moon representation means and a continuous scale disposed on the front surface thereof, drive means for rotating the moon disk at a rate corresponding to the rate of the lunar orbit, marker means for marking a position of the moon representation means that indicates a phase of the moon at a given time and for marking a division of the continuous scale, and a stationary vernier scale positioned adjacent to the continuous scale for measuring a fractional part of the division of the continuous scale marked by the marker means. Also provided is a tide clock for indicating a state of the tide. The tide clock comprises a tide disk rotatable about a central axis having tide representation means for representing a high tide disposed on the front surface thereof, marker means for marking a position of the tide representation means that indicates the time of the high tide and drive means for rotating the tide disk at a rate of approximately one revolution every 12 hours and 25 minutes. Also provided is a nautical clock comprising both the moon clock and the tide clock. The moon clock of the nautical clock is particularly useful in setting the tide clock.

14 Claims, 6 Drawing Sheets

NAUTICAL MOON AND TIDE CLOCK APPARATUS

BACKGROUND OF THE INVENTION

1. Field of the Invention

The present invention relates generally to clocks, and more particularly, to clocks for indicating the phase of the moon and clocks for indicating the state of the tide.

2. Background of the Invention

Clocks for indicating the phase of the moon (e.g., new, full) and clocks for indicating the state of the tide (e.g., low, high) have existed for years. Both "moon" clocks and "tide" clocks have utility in many applications.

Most moon clocks indicate the position and phase of the moon relative to the earth by providing a presentation of the lunar orbit. Typically, a disk depicting two diametrically opposed images of the moon is rotated behind the face of the clock at a rate of approximately one revolution every 59 days, i.e., one revolution every two lunar months. The 29½ day lunar cycle is represented by one of the moon images as the disk rotates 180 degrees. The clock face shields appropriate portions of the representative moon image to provide an indication of the moon phase.

In many moon clocks, a graduated scale is disposed adjacent to the periphery of the disk. Each division of the scale represents a 24 hour day in the lunar cycle allowing the moon clock to be set to the nearest day and the number of days between moon phases to be measured.

Tides are primarily caused by the gravitational pull exerted on the earth by the moon and the sun. The gravitational pull exerted by the moon is the dominant force. Based on the 24 hour and 50 minute period of time in a lunar day, e.g., the average time between moonrise to moonrise on two consecutive nights, there is a high tide approximately every 12 hours and 25 minutes. A low tide typically occurs every 6 hours and 13 minutes after each high tide. Tide clocks are based on this time cycle. For example, most tide clocks indicate the occurance of a high tide every 12 hours and 25 minutes.

In fact, successive high tides and successive low tides do not always occur exactly 12 hours and 50 minutes apart. Due to many factors such as the relative locations of the moon and sun with respect to the earth and the inclinations of the orbits of the sun and moon with respect to the orbit of the earth, the tidal cycle varies throughout each month and throughout each year. As a result, although a tide clock can provide a rough indication of the time of the tides at certain times, it can be quite inaccurate at other times.

It has been discovered that the accuracy of a tide clock in indicating the times of the tides significantly varies depending on the time during the lunar cycle in which it is set. The times on certain tides on certain days of the lunar cycle correspond more accurately to the times that would be expected based on the average times of corresponding tides than do the times of other tides on other days. This discovery allows a tide clock to be set in such a manner that throughout the year the indicated times of the tides will show the least deviation from the actual times of the tides.

In order to set a tide clock in accordance with a particular time of the lunar cycle, the time of at least one moon phase must be determined. A tide clock can be set with reasonable accuracy based on the indication provided by an accurate moon clock.

By the present invention, an improved moon clock and an improved tide clock are provided. The indication provided by the moon clock is more precise than the indication provided by moon clocks developed heretofore. The tide clock provides a simplified presentation of the state of the tide. The precise indication provided by the moon clock can be used to set the tide clock in accordance with the discovery described above. A single clock comprising both the moon clock and the tide clock is also provided.

SUMMARY OF THE INVENTION

In one aspect, the present invention provides a moon clock for indicating a phase of the moon. The moon clock comprises a base and a moon disk attached to the base and rotatable about a central axis perpendicularly extending therefrom. The moon disk includes a front surface, moon representation means fixedly disposed on the surface for representing a moon and a continuous graduated scale disposed on the surface adjacent to the periphery thereof, the continuous scale having a plurality of equally spaced divisions, each division representing one 24 hour day of a lunar month. Drive means are attached to the base for rotating the moon disk about the axis in a clockwise direction at a rate corresponding to the lunar orbit. Marker means are fixedly attached to the base in a position adjacent to the continuous scale of the moon disk for marking a position of the moon representation means with respect to the base that indicates a phase of the moon at a given time and marking a division of the continuous scale whereby the number of divisions of the continuous scale in a counterclockwise direction from the marker means to the moon representation means indicates the number of days before the phase will occur and the number of divisions of the continuous scale in a clockwise direction from the marker means to the moon representation means indicates the number of days after the phase last occurred. A vernier scale is fixedly attached to the base in a position adjacent to the continuous scale of the moon disk for measuring a fractional part of the division of the continous scale marked by the marker means.

In a second aspect, the present invention provides a tide clock for indicating a state of the tide. The tide clock comprises a base and a tide disk attached to the base and rotatable about a central axis perpendicularly extending therefrom. The tide disk includes a front surface and tide representation means fixedly disposed on the surface for representing a high tide. Marker means are fixedly attached to the base for marking a position of the tide representation means with respect to the base that indicates the time of the high tide, and drive means are attached to the base for rotating the tide disk about the axis at a rate of approximately one revolution every 12 hours and 25 minutes. The tide representation means comprise a flat circular member eccentrically disposed on the front surface of the tide disk in a position such that the periphery of the circular member is contained within the periphery of the tide disk whereby the point on the front surface of the tide disk of the greatest distance between the periphery of the circular member and the periphery of the tide disk represents the high tide.

In a third aspect, the present invention provides a nautical clock. The nautical clock comprises the moon clock of the first aspect of the present invention and the tide clock of the second aspect of the present invention. In one embodiment, the nautical clock also includes a conventional time clock for indicating the time of day.

It is, therefore, a principal object of the present invention to provide a moon clock that provides a more precise indication of the position and phase of the moon than moon clocks developed heretofore.

It is also a principal object of the present invention to provide a tide clock that provides a simplified presentation of the state of the tide.

It is also a principal object of the present invention to provide a nautical clock that includes both a moon clock and a tide clock.

Other and further objects, features and advantages of the present invention will be readily apparent to those skilled in the art upon a reading of the description of the preferred embodiments which follows when taken in conjunction with the accompanying drawings.

DETAILED DESCRIPTION OF PREFERRED EMBODIMENTS

In a first aspect, the present invention provides an improved moon clock. In a second aspect, the present invention provides an improved tide clock. In a third aspect, the present invention provides a nautical clock that comprises the improved moon clock and the improved tide clock.

The Moon Clock

The moon clock of the present invention can be used in a variety of applications. It can be used by itself in the form of a clock or watch or in conjunction with other clocks. For example, the moon clock can be combined with a conventional daily time clock in the form of a case clock. The nautical clock of the present invention combines the moon clock with the improved tide clock of the present invention and a conventional daily time clock.

Figure 1:
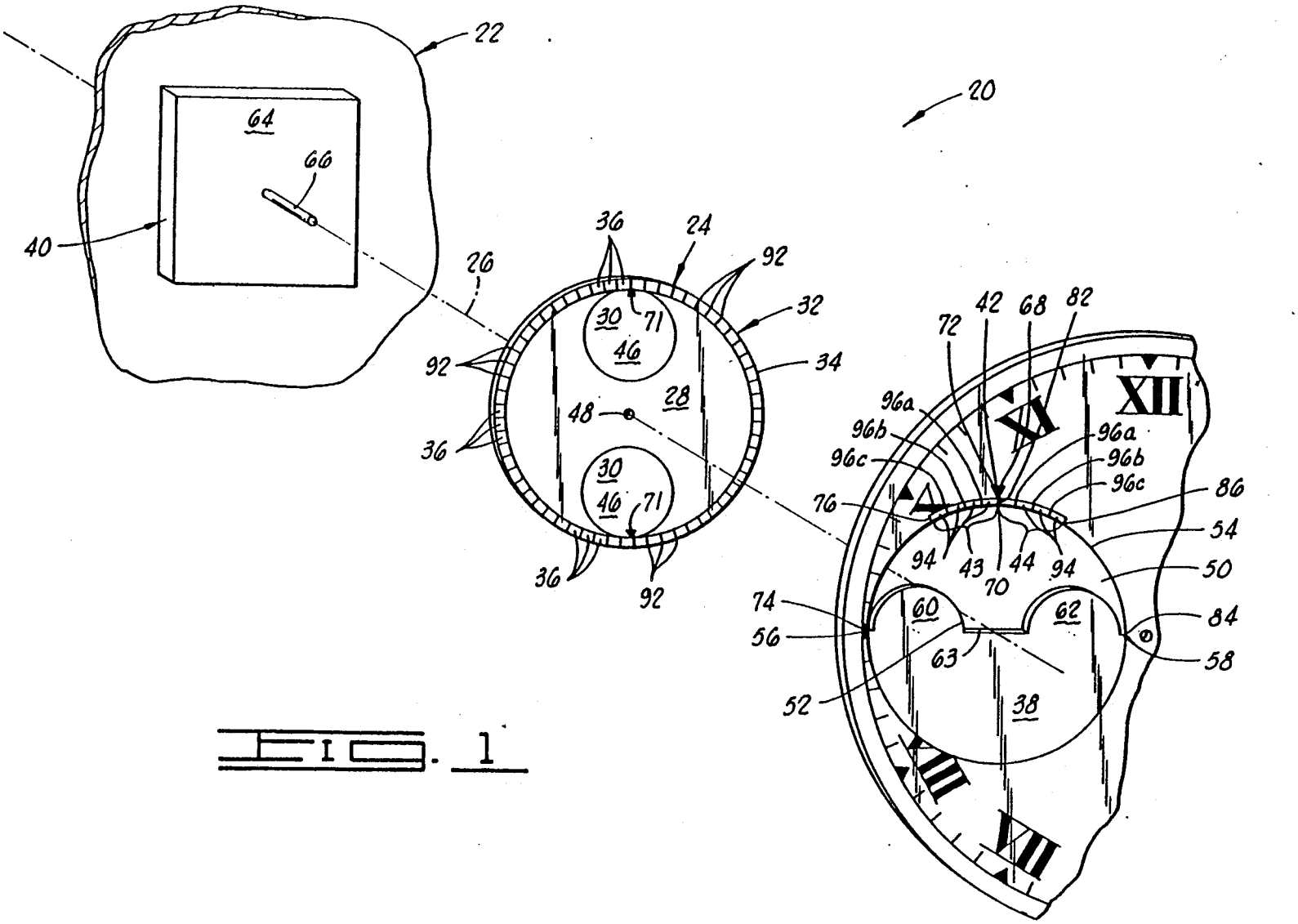
FIG. 1 is an exploded view showing the moon clock of the present invention.
Figure 2:
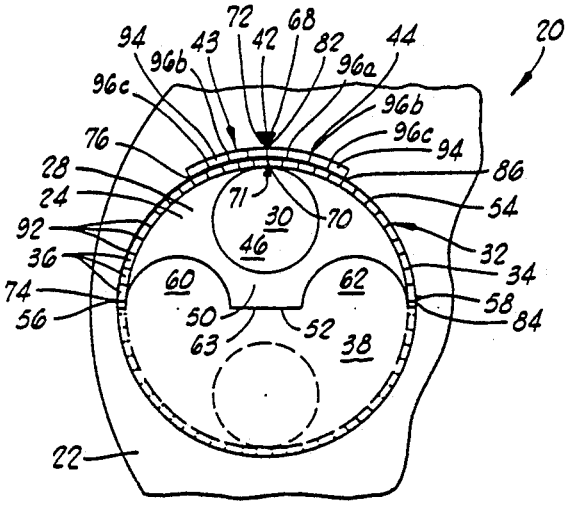
FIG. 2 is a front view of the moon clock illustrated in FIG. 1.

Referring now to the drawings and particularly to FIGS. 1–6, the moon clock of the present invention is illustrated and generally designated by the numeral 20. As best shown in FIGS. 1 and 2, the moon clock 20 comprises a base 22 and a moon disk 24 attached to the base and rotatable about a central axis 26 perpendicularly extending from the base. The moon disk 24 includes a front surface 28, moon representation means 30 disposed on the surface 28 for representing a moon and a continuous graduated scale 32 disposed on the surface 28 adjacent to the periphery 34 of the moon disk. The continuous scale 32 has a plurality of equally spaced divisions 36, each division 36 representing one 24 hour day of a lunar month.

A clock face 38 is fixedly attached to the base 22 in a position adjacent to the moon disk 24. Drive means 40 are attached to the base 22 for rotating the moon disk 24 about the axis 26 in a clockwise direction at a rate corresponding to the rate of the lunar orbit. Marker means 42 are fixedly attached to the clock face 38 in a position adjacent to the continuous scale 32 of the moon disk 24 for marking a position of the moon representation means 30 with respect to the base 22 and clock face that indicates a phase of the moon at a given time and marking a division 36 of the continuous scale 32. The number of divisions 36 of the continuous scale 32 in a counterclockwise direction from the marker means 42 to the moon representation means 30 indicates the number of days before the phase will occur and the number of divisions 36 of the continuous scale 32 in a clockwise direction from the marker means 42 to the moon representation means 30 indicates the number of days after the phase last occurred. A first vernier scale 43 is fixedly attached to the clock face 38 in a position adjacent to the continuous scale 32 of the moon disk 24 for measuring a fractional part of the division 36 of the continuous scale 32 marked by the marker means 42. A second vernier scale 44 is fixedly attached to the clock face 38 in a position adjacent to the continuous scale 32 of the moon disk 24 for measuring a fractional part of the division 36 of the continuous scale 32 marked by the marker means 42.

The nature of the base 22 will vary depending upon the form of the moon clock 20. The base 22 can be the housing or part of the housing of the clock or watch or can be another part of the clock or watch.

The moon disk 24 is a thin, circular plate. The front surface 28 of the moon disk 24 is flat. The moon representation means 30 comprise two moon images 46 disposed on the front surface 28 between the center 48 and the periphery 34 of the moon disk 24 in opposite positions, i.e., in positions 180 degrees apart. The moon images 46 are images of a full moon. They can be either actual objects representing the full moon attached to the surface 28 or illustrations of the full moon painted on or otherwise affixed to the surface 28. If desired, various ornamental designs (objects, illustrations, etc.) can be disposed on the front surface 28 of the moon disk 24 with the moon images 46.

The continuous graduated scale 32 is disposed on the front surface 28 of the moon disk 24 directly adjacent to the periphery 34 of the moon disk between the periphery 34 and the moon images 46. The scale 32 contains 59 divisions 36, each division 36 representing one 24 hour day of a lunar month (approximately 29 days and 12 hours). If desired, each division 36 can be divided into subdivisions. The divisions 36 and/or subdivisions thereof can be numbered as well.

The clock face 38 shields the rotating moon disk 24 such that only one moon image 46 can be seen at a time. A portion of the upper half of the rotating moon disk 24 is visible through a crescent-shaped opening 50 in the clock face 38. The opening 50 includes a base 52 and a curvilinear top 54 extending from one end 56 of the base to the other end 58 of the base. Two equally spaced semicircular projections 60 and 62 of the clock face 38 extend into the opening 50 from a linear portion 63 of the base 52. Approximately 29½ of the divisions 36 of the continuous scale 32 are visible through the opening 50 at one time. Rotation of the moon disk 24 one-half of a revolution (180 degrees) over the 29½ day lunar cycle represents a single lunar orbit.

When the moon clock 20 is properly set, the moon images 46 will be approximately centered behind the projections 60 and 62 of the clock face 38. As the moon disk 24 rotates in a clockwise direction 180 degrees, the moon image 46 positioned behind the projection 60 advances in a clockwise direction on a path adjacent to the curvilinear top 54 of the opening 50 to a position approximately centered behind the projection 62. The moon image 46 positioned behind the projection 62 advances in a clockwise direction on a path out of sight (below the opening 50) to a position approximately centered behind the projection 60. In the next lunar cycle, the representation is repeated with the moon images 46 following opposite paths.

The circular projections 60 and 62 of the clock face 38 shield appropriate portions of the representative moon image 46 as it moves along its path to indicate the phase of the moon. For example, when the moon is in a waxing crescent phase, only a portion of the representative moon image 46 appears above the projection 60. When the moon is in the full moon phase, the representative moon image 46 is not shielded by either the projection 60 or the projection 62. When the moon is in a waning crescent phase, only a portion of the representative moon image 46 is visible above the projection 62.

The drive means 40 rotate the moon disk 24 about the axis 26 in a clockwise direction at a rate of approximately one revolution every 59 days or two lunar months. Accordingly, the moon disk 24 rotates 180 degrees every 29½ days or single lunar month. This approximates the actual lunar orbit time of 29 days, 12 hours, 44 minutes and 2.8 seconds. The continuous scale 32 of the moon disk 24 is rotated by one division 36 with respect to the marker means 42 each 24 hour day.

The drive means 40 can comprise conventional means for running moon clocks. Examples of such conventional means are described in U.S. Pat. Nos. 508,467, 3,721,083 and 4,692,031, the disclosures of which are incorporated by reference herein. In one embodiment, the drive means 40 generally comprise a conventional motor 64 (electrical or straight mechanical) and a drive shaft 66 connecting the motor to the moon disk 24. Of course, the exact type of drive means employed depends, to a large extent, on the form of the moon clock.

The marker means 42 comprise a pointer 68 disposed on the clock face 38 in a position above the opening 50 of the clock face. The pointer 68 points to the exact center point 70 of the curvilinear top 54 of the opening 50 of the clock face 38 marking the position of the representative moon image 46 with respect to the base 22 and clock face 38 that indicates when a full moon occurs and marking a division 36 of the continuous scale 32 of the moon disk 24. The center point 70 is disposed directly between the vernier scales 43 and 44 as such scales are positioned in FIGS. 1 and 2. In an alternate embodiment, the marker means 42 merely comprise the center point 70, i.e., there is no pointer. The number of the divisions 36 of the continuous scale 32 in a counterclockwise direction from the pointer 68 to the center point 71 of the closest moon image 46 indicates the number of days before the full moon will occur. For example, when the moon is in the first half moon phase, there will be approximately 7⅜ of the divisions 36 between the center point 71 of the representative moon image 46 and the pointer 68. The number of the divisions 36 of the continuous scale 32 in a clockwise direction from the pointer 68 to the center point 71 of the closest moon image 46 indicates the number of days after the full moon last occurred. For example, when the moon is in a waning crescent phase, there will be between 11 and 12 of the divisions 36 between the center point 71 of the representative moon image 46 and the pointer 68. Of course, at the time of a full mooon, the center point 71 of the representative moon image 46 will be directly in line with the center point 70 and the pointer 68.

The vernier scales 43 and 44 allow the time before the full moon occurs or the time after the full moon last occurred to be determined more precisely. As used herein and in the appended claims, a vernier scale means a graduated scale graduated such that a convenient number of its divisions are just equal in length to a number (either one less or one more) of the divisions 36 of the continuous scale 32 of the moon disk 24 so that a fraction of the division 36 of the continuous scale 32 marked by the pointer 68 can be determined by observing what division dividing line of the vernier scale coincides with a division dividing line of the continuous scale.

Figure 3:
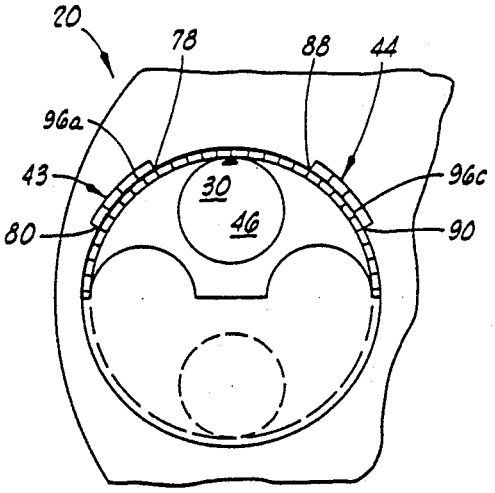
FIG. 3 is a front view of an alternate embodiment of the moon clock of the present invention.

The first vernier scale 43 can be attached to the clock face 38 in any position adjacent to the continuous scale 32 of the moon disk 24 between a point 72 adjacent to the continuous scale directly adjacent to the pointer 68 and, in a counterclockwise direction therefrom, a point 74 adjacent to the continuous scale 90 degrees from the point 72. This position of the vernier scale 43 is useful when the scale 43 is used to measure a fractional part of the division 36 of the continuous scale 32 marked by the pointer 68 when the number of days before the full moon will occur is being measured. As shown in FIGS. 1 and 2, the vernier scale 43 is attached to the clock face 38 in a position adjacent to the continous scale 32 between the point 72 and, in a counterclockwise direction therefrom, a point 76 adjacent to the continuous scale. As shown in FIG. 3, the vernier scale 43 is attached to the clock face 38 in a position adjacent to the continous scale 32 between a point 78 adjacent to the continuous scale and, in a counterclockwise direction therefrom, a point 80 adjacent to the continuous scale.

The second vernier scale 44 can be attached to the clock face 38 in any position adjacent to the continuous scale 32 between a point 82 adjacent to the continuous scale directly adjacent to the pointer 70 and, in a clockwise direction therefrom, a point 84 adjacent to the continuous scale 90 degrees from the point 82. This position of the vernier scale 44 is useful when the scale 44 is used to measure a fractional part of the division 36 of the continuous scale 32 marked by the pointer 68 when the number of days after the full moon last occurred is being measured. As shown in FIGS. 1 and 2, the vernier scale 44 is attached to the clock face 38 in a position adjacent to the continuous scale 32 between the point 82 and, in a clockwise direction therefrom, a point 86 adjacent to the continuous scale. As shown in FIG. 3, the vernier scale 44 is attached to the clock face 38 in a position adjacent to the continuous scale 32 between a point 88 adjacent to the continuous scale and, in a clockwise direction therefrom, a point 90 adjacent to the continuous scale.

Although only one vernier scale is needed, the use of two vernier scales as described above makes the moon clock 20 easier to read. If the time being determined is the time before the full moon will occur, the vernier scale 43 is used. If the time being determined is the time after the full moon last occurred, the vernier scale 44 is used. When the vernier scales 43 and 44 are positioned in the positions shown in FIGS. 1 and 2, a "double" vernier scale is formed allowing the fractional part of the division 36 of the continuous scale 32 marked by the pointer 68 to be most easily determined. Of course, if the pointer 68 points directly to a division dividing line 92 of the continuous scale 32, an exact whole number of days exist before or after the full moon. In this case, the vernier scales 43 and 44 are not needed. If desired, the positions of the vernier scales 43 and 44 can be reversed.

The vernier scales 43 and 44 each have four equally spaced divisions 94 divided by division dividing lines 96*a–c* and a length equal to the length of five of the divisions 36 of the continuous scale 32. This imparts an accuracy to the moon clock 20 that is four times greater than the accuracy of moon clocks developed heretofore. If desired, the number of the divisions of the vernier scales can be varied. For example, if the vernier scales have 8 divisions for every 9 divisions of the continuous scale, the accuracy of the moon clock 20 will be eight times greater than the accuracy of moon clocks developed heretofore.

Figure 4:
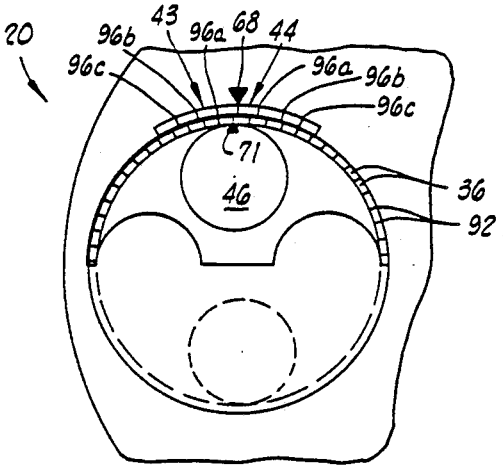
FIGS. 4–6 are front views of the moon clock of the present invention illustrating operation thereof.
Figure 5:
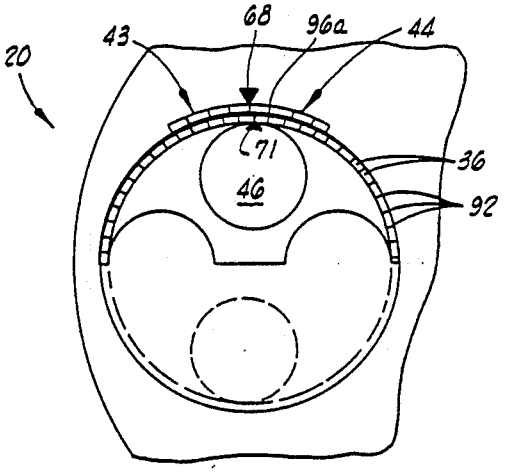
Figure 6:
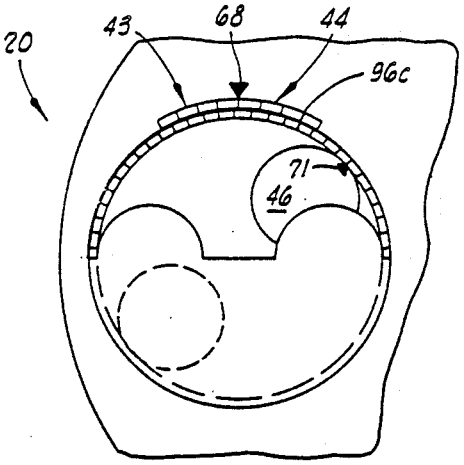

Referring now to FIGS. 4–6, operation of the moon clock 20 will be described. The moon clock is first set in accordance with the time before or after the next or last full moon. The time of the next or last full moon can be determined from a source such as a Gregorian calendar or a daily newspaper. For example, assume that it is eight o'clock in the evening on Jan. 30, 1990 and that a full moon last occurred 7 days and 12 hours before, i.e., at eight o'clock in the morning on Jan. 23, 1990. The center point 71 of one of the moon images 46 is first positioned such that seven of the divisions 36 are between the center point 71 and the pointer 68 in a clockwise direction from the pointer. This position indicates that the full moon occurred seven days ago. To make the moon clock reflect the additional twelve hours, the moon disk 24 is rotated such that a division dividing line 92 of the continuous scale 32 lines up with the division dividing line 96*b* of the second vernier scale 44. The moon clock will thereafter provide an indication of the phase of the moon and the time before the next full moon will occur or after the last full moon occurred to the nearest one-fourth of a day. Of course, the time before other phases of the moon will occur or after other phases of the moon last occurred can be easily determined from the time of the next or last full moon.

As shown in FIG. 4, there is less than one division between the center point 71 of the moon image 46 and the pointer 68. Inasmuch as the center point 71 of the moon image 46 has not reached the pointer 68, the vernier scale 43 is used. By glancing at the vernier scale 43, it can be seen that the division dividing line 96*a* is in alignment with one of the division dividing lines 92 of the continuous scale 32 on the moon disk 24. This indicates that a full moon will occur in approximately six hours.

As shown in FIG. 5, there is less than one division 36 between the center point 71 of the moon image 46 and the pointer 68. Inasmuch as the center point 71 of the moon image 46 is to the right of the pointer 68, the vernier scale 44 is used. As shown, the division dividing line 96*a* of the vernier scale 44 is in alignment with one of the division dividing lines 92 of the continuous scale 32 of the moon disk 24. This indicates that a full moon occurred six hours ago. As shown in FIG. 6, the full moon occurred seven days and eighteen hours before.

Thus, the moon clock of the present invention provides a more accurate indication of the current phase of the moon and the time before or after a particular moon phase. The scope of the invention is not limited to the particular embodiments of the moon clock described above. For example, a stationary scale having 29½ divisions, each division representing a 24 hour day in a lunar month, can be placed on the clock face adjacent to the periphery of the moon disk. In this embodiment, the vernier scale or a series of vernier scales can be placed on the rotating moon disk. Instead of employing two diametrically opposed moon images 44 and rotating the moon disk at a rate of one revolution every 59 days, one moon image 46 can be disposed on the moon disk and the moon disk can be rotated at a rate of approximately one revolution every 29½ days.

The Tide Clock

Figure 7:
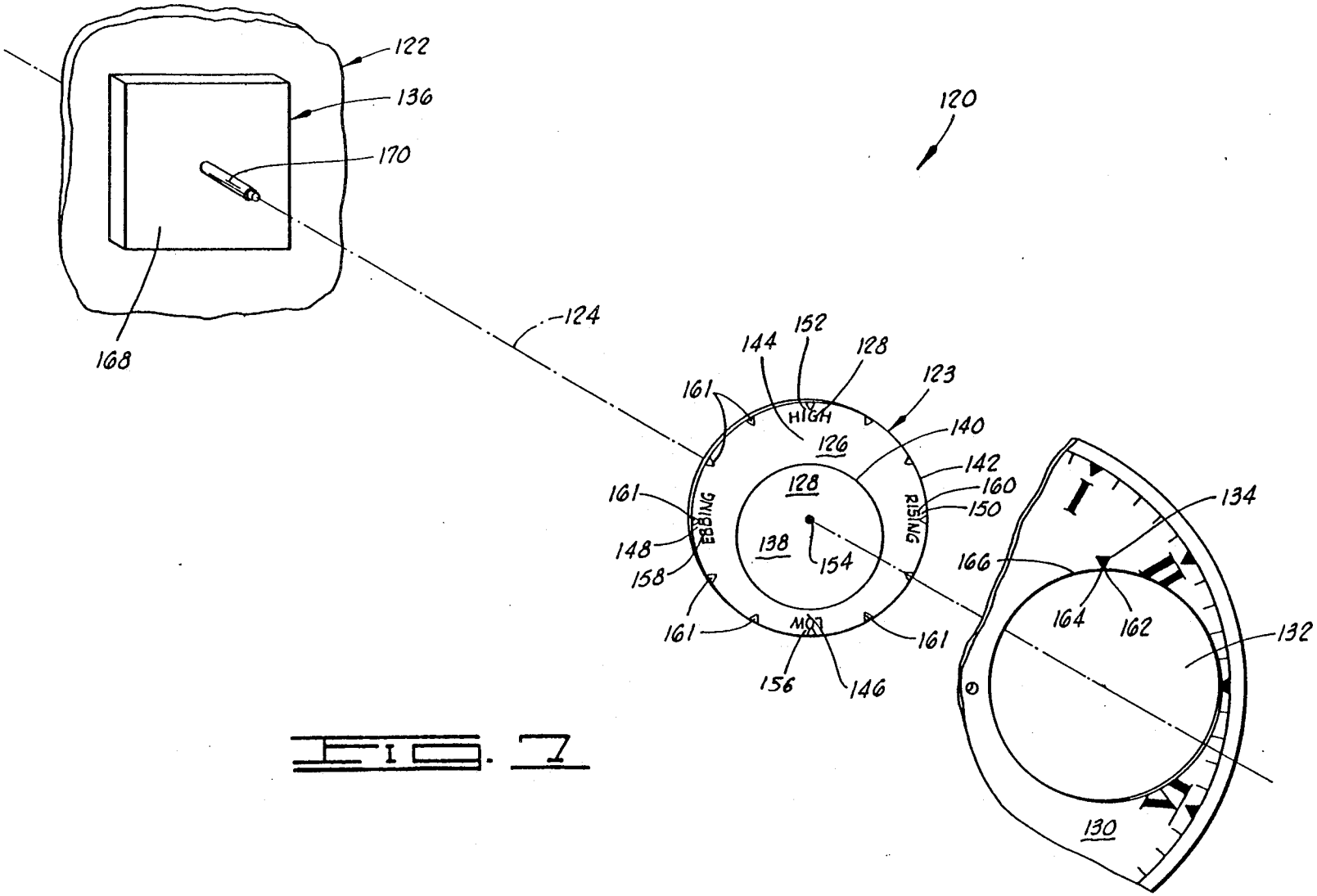
FIG. 7 is an exploded view showing the tide clock of the present invention.
Figure 8:
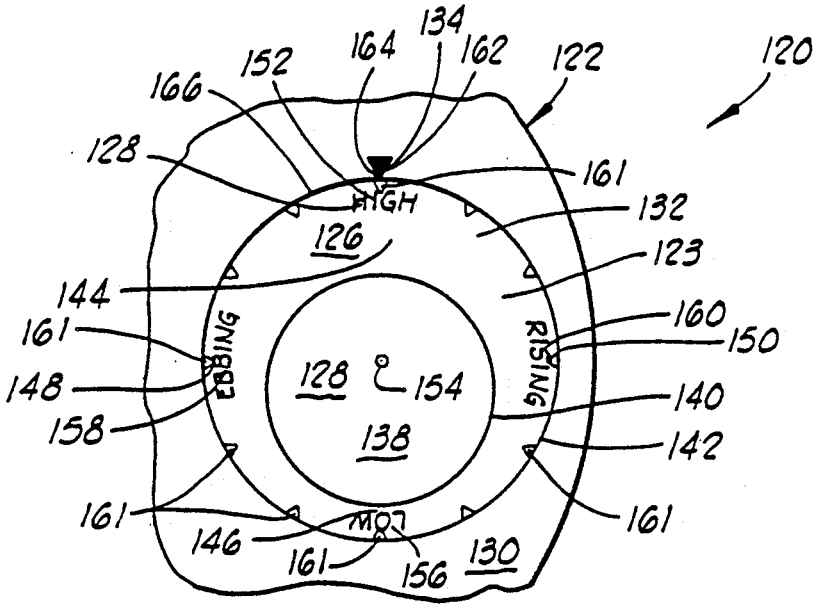
FIGS. 8 and 9 are front views of the tide clock of the present invention illustrating operation thereof.
Figure 9:
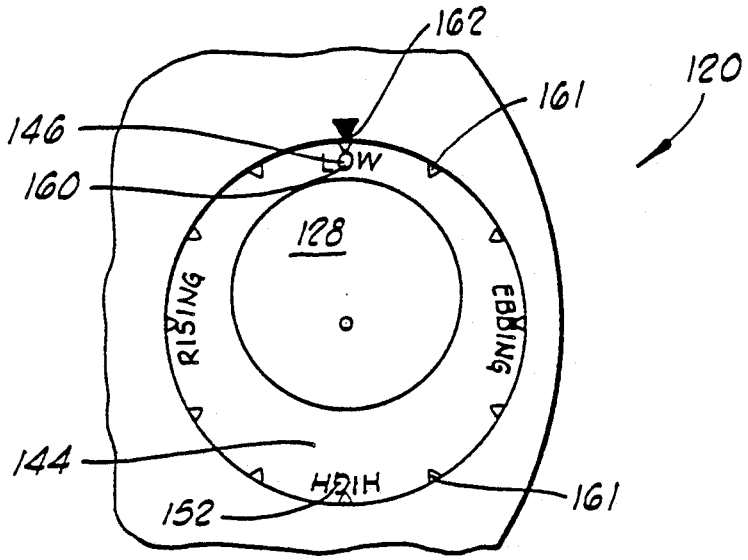

Referring to FIGS. 7–9, the tide clock of the present invention is illustrated and generally designated by the numeral 120. As best shown in FIGS. 7 and 8, the tide clock 120 comprises a base 122 and a tide disk 123 attached to the base and rotatable about a central axis 124 perpendicularly extending therefrom. The tide disk 123 includes a front surface 126 and tide representation means 128 fixedly disposed on the surface 126 for representing a high tide. A clock face 130 having a circular opening 132 disposed therethrough is fixedly attached to the base 122 adjacent to the tide disk 123. The tide disk 123 is visible through the opening 132.

Marker means 134 are fixedly attached to the clock face 130 for marking a position of the tide representation means 128 with respect to the base 122 and clock face 130 that indicates the time of the high tide. Drive means 136 are attached to the base 122 for rotating the tide disk 123 about the axis 124 at a rate of approximately one revolution every 12 hours and 25 minutes.

Like the nature of the base 22 of the moon clock 20, the base 122 of the tide clock 120 will vary depending upon the form of the clock. The tide disk 123 is a thin, circular plate. The front surface 126 of the tide disk 123 is flat.

The tide representation means 128 comprise a flat circular member 138 eccentrically disposed (i.e., disposed off center) on the front surface 126 of the tide disk 123 in a position such that the periphery 140 of the circular member is contained within the periphery 142 of the tide disk whereby the point on the surface 126 of the greatest distance between the periphery 140 and the periphery 142, i.e., the point 144, represents the high tide. The point on the front surface 126 of the tide disk 123 of the least distance between the periphery 140 of the circular member and the periphery 142 of the tide disk, i.e., the point 146, represents a low tide. Points on the front surface 126 of the tide disk 123 of an intermediate distance between the periphery 140 of the circular member and the periphery 142 of the tide disk represent other stages of the tide. For example, the point 148 on the surface 126 represents that the tide is in an ebbing stage whereas the point 150 represents that the tide is in a rising stage.

The tide representation means 128 also comprise a mark 152 (the word "HIGH") representing the high tide disposed on the front surface 126 of the tide disk 123 between the center 154 and the periphery 142 thereof. Marks 156 ("LOW"), 158 ("EBBING") and 160 ("RISING") indicating a low tide, an ebbing tide and a rising tide, respectively, are also disposed on the front surface 126 of the tide disk 123 between the center 154 and the periphery 142 thereof. The marks 152, 156, 158 and 160 are all disposed on or adjacent to the corresponding points 144, 146, 148 and 150 on the tide disk 123. Additional marks 161 are disposed on the front surface 126 of the tide disk 123 between the center 154 and periphery 142 thereof for indicating the approximate number of hours between the tide stages.

The circular opening 132 in the clock face 130 is preferably large enough to allow the entire disk 123 to be visible therethrough. The marker means 134 comprise a pointer 162 disposed on the clock face 130 in a position above the opening 132. The pointer 162 points to the exact center point 164 of the top portion 166 of the opening 132 marking the position of the tide representation means 128 (the point 144 and mark 152) with respect to the base 122 and clock face 130 that indicates the time of the high tide. When the point 146 and mark 156 on the front surface 126 of the tide disk 123 are marked by the pointer 162, a low tide is indicated. Similarly, when the point 148 and mark 158 are marked by the pointer 162, an ebbing tide is indicated and when the point 150 and mark 160 are marked by the pointer 162, a rising tide is indicated. In an alternate embodiment, the marker means is merely the center point 164 of the top portion 166 of the opening 132 of the clock face 130. In this embodiment, there is no pointer.

Thus, the state of the tide is always indicated at the top of the opening 132 of the clock face 130. This results in a very simplified presentation.

The drive means 136 rotate the tide disk 123 about the axis 124 in a clockwise direction at a rate of approximately one revolution every 12 hours and 25 minutes. The drive means 136 can comprise conventional means for running clocks. In one embodiment, the drive means 136 generally comprise a conventional motor 168 (electrical or straight mechanical) and a drive shaft 170 connecting the motor to the tide disk 123. Of course, like the type of drive means employed in the moon clock 20, the type of drive means employed in the tide clock 120 depends, to a large extent, on the form of the clock.

Referring now to FIGS. 8 and 9, operation of the tide clock 120 will be described. The tide clock 120 is set according to the state of the tide at the time. Various sources are available for determining the exact times of each tide for a particular location. For example, if it is determined that high tide will occur at ten o'clock p.m., the tide clock 120 is set such that the point 144 and mark 152 will be directly in line with the pointer 162 at ten o'clock p.m. Once set, the tide clock 120 will provide an indication of the state of the tide at any given time.

It can be very beneficial to set the tide clock according to the particular time of the tide on the day of the lunar cycle that will have the least deviation from the times of successive corresponding tides.

Referring to FIG. 8, the position of the tide representation means 128 with respect to the pointer 162 indicates that a high tide is occurring at the time. In FIG. 9, the position of the tide representation means 128 with respect to the pointer 162 indicates that a low tide is occurring at the time.

The Nautical Clock

Figure 10:
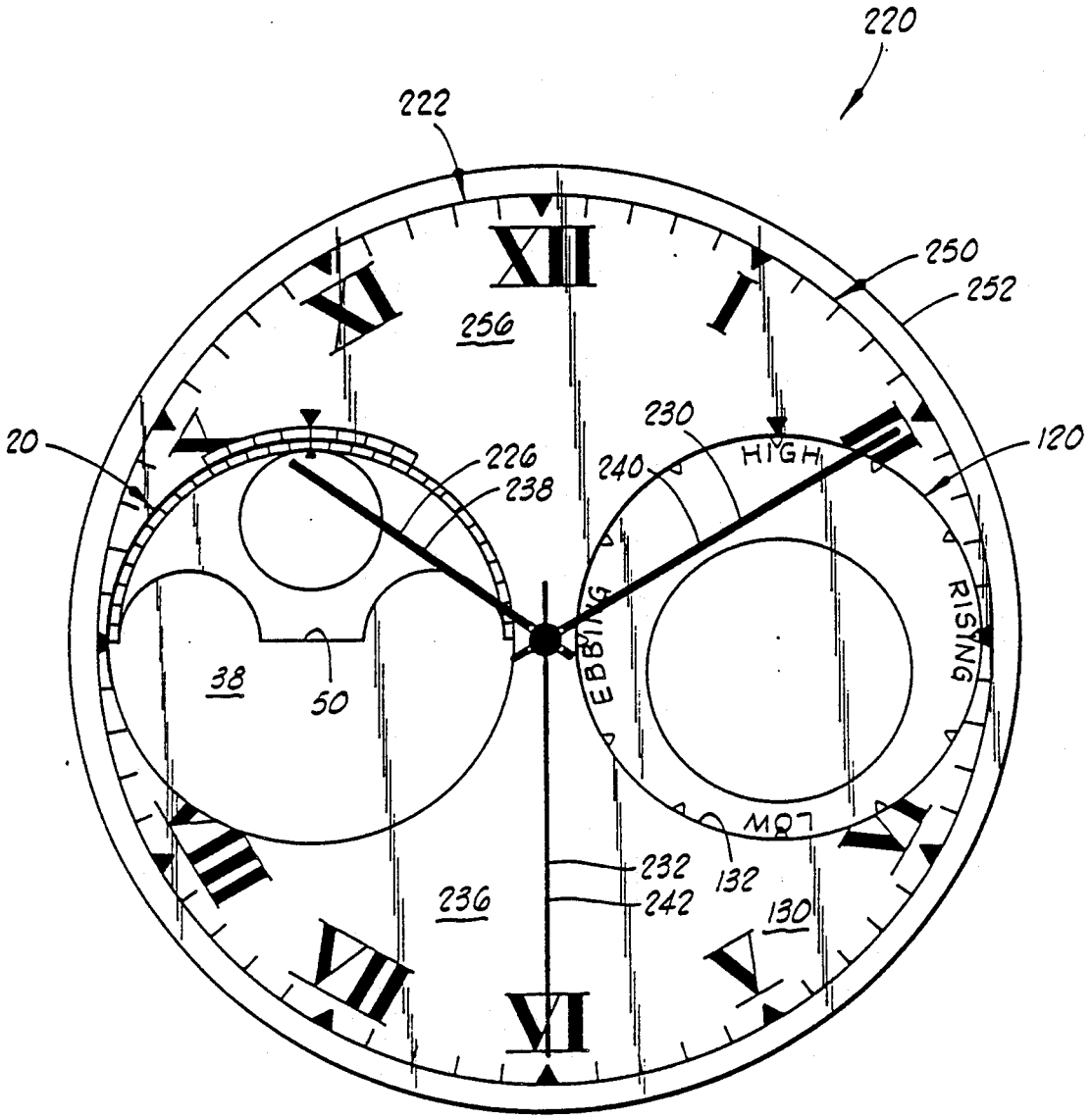
FIG. 10 is a front view of the nautical clock of the present invention.
Figure 11:
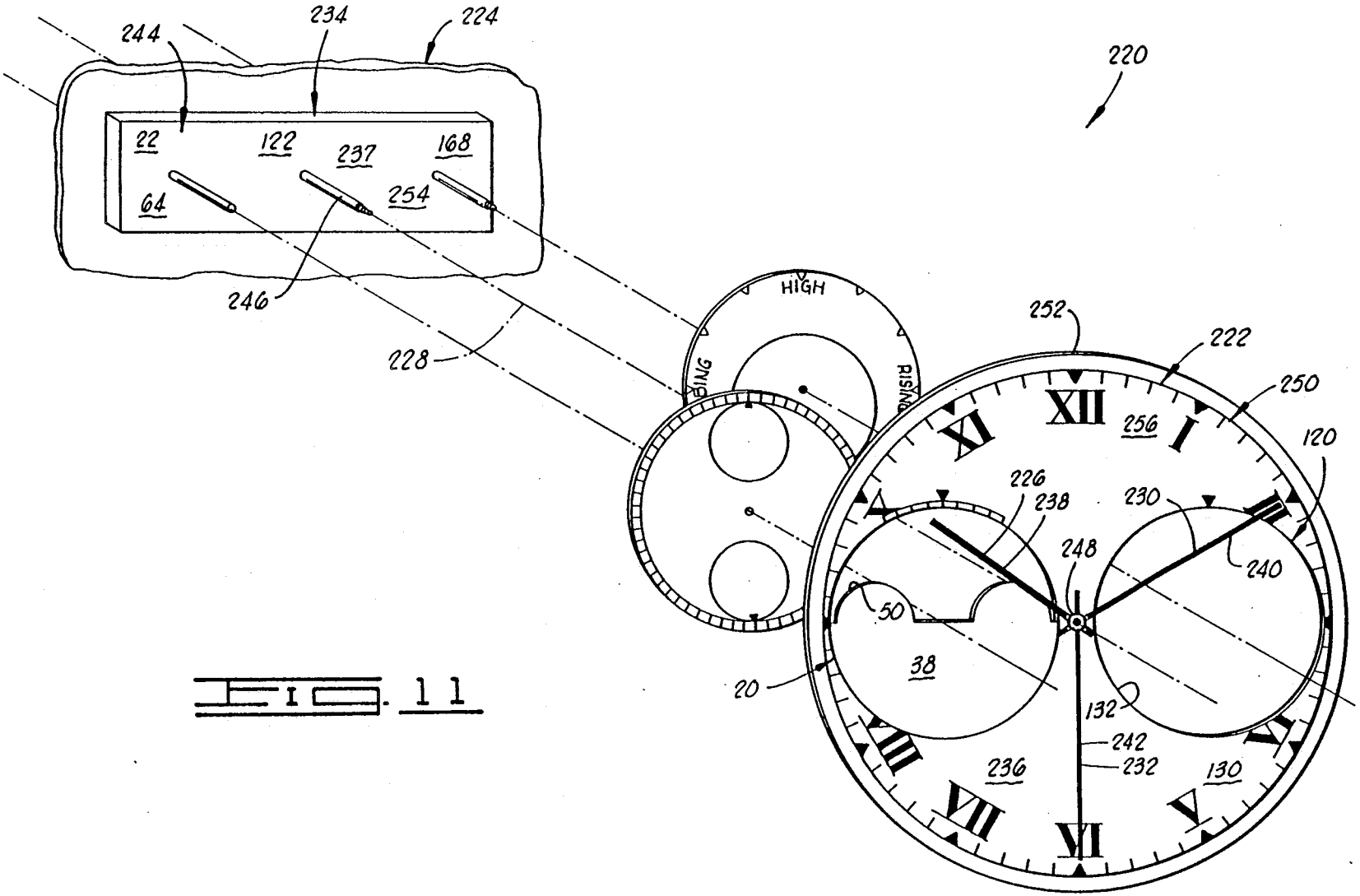
FIG. 11 is an exploded view showing the nautical clock of the present invention.

Referring now to FIGS. 10 and 11, the nautical clock of the present invention is illustrated and generally designated by the numeral 220. The nautical clock 220 comprises the moon clock 20, the tide clock 120 and a conventional daily time clock 222.

The conventional daily time clock 222 comprises a base 224, hour indicator means 226 attached to the base 224 and rotatable about a central axis 228 perpendicularly extending from the base, minute indicator means 230 attached to the base 224 and rotatable about the axis 228 and second indicator means 232 attached to the base 224 and rotatable about the axis 228. Drive means 234 are attached to the base 224 for rotating the hour indicator means 226 one revolution every twelve hours, the minute indicator means 230 one revolution every hour and the second indicator means 232 one revolution every minute. A clock face 236 is fixedly attached to the base 224.

As shown by FIG. 11, the base 22 of the moon clock, base 122 of the tide clock and base 224 of the conventional clock are integrated into a single base 237. The base 237 can be the housing or part of the housing of the nautical clock 220 or can be another part of the clock.

The hour indicator means 226, minute indicator means 230 and second indicator means 232 comprise an hour hand 238, minute hand 240 and second hand 242, respectively. The drive means 234 comprise conventional means for running clocks. In one embodiment, the drive means 234 comprise a motor (electrical or straight mechanical) 244 and drive shaft 246 extending from the motor through an opening 248 in the clock face 236. The hands 238, 240 and 242 are attached to the drive shaft 246 such that they are positioned in front of the clock face 236 on a plane parallel to the plane thereof. A conventional twelve hour time scale 250 is positioned on the clock face 236 adjacent the periphery 252 thereof. As shown in FIG. 11, the motor 244 of the conventional time clock, motor 64 of the moon clock and motor 168 of the tide clock are integrated into a single motor 254. Similarly, the clock face 236 of the conventional time clock 220, clock face 38 of the moon clock 20 and clock face 130 of the tide clock 120 are integrated into a single clock face 256. The opening 50 in the face of the moon clock, the opening 132 in the face of the tide clock, and the opening 248 in the face of the conventional time clock are all disposed through the clock face 256. As shown in FIGS. 10 and 11, the moon clock 20 and tide clock 120 are positioned side by side on the clock face 256. Various other positions of the clocks 20, 120 and 222 of the nautical clock 220 can be employed.

As used herein and in the appended claims, "attached to the base" means attached indirectly or directly to the base. For example, the moon disk 24 can be attached to the drive shaft 66 which can be attached to the motor 64 which can be attached to the base 22. The marker means 42 and vernier scales 43 and 44 can be attached to the clock face 38 which can be attached to the base 22. The tide disk 123 can be attached to the drive shaft 170 which can be attached to the motor 168 which can be attached to the base 122. The pointer 162 can be attached to the clock face 130 which can be attached to the base 122. The hour hand 238, minute hand 240 and second hand 242 can be attached to various gears (not shown) which can be attached to the drive shaft 246 which can be attached to the motor 254 which can be attached to the base 237.

Thus, the moon clock, tide clock and nautical clock of the present invention are well adapted to carry out the objects and attain the ends and advantages mentioned as well as those inherent therein. While numerous changes in the arrangement and construction of parts will suggest themselves to those skilled in the art, such changes are encompassed within the scope of this invention as defined by the appended claims.

What is claimed is:

1. A moon clock for indicating a phase of the moon comprising:

a base;

a moon disk attached to said base and rotatable about a central axis perpendicularly extending therefrom, said moon disk including:

a front surface;

moon representation means fixedly disposed on said surface for representing a moon; and a continuous graduated scale fixedly disposed on said surface adjacent to the periphery thereof, said continuous scale having a plurality of equally spaced divisions, each division representing one 24 hour day of a lunar month;

drive means attached to said base for rotating said moon disk about said axis in a clockwise direction at a rate corresponding to the rate of the lunar orbit;

marker means fixedly attached to said base in a position adjacent to said continuous scale of said moon disk for marking a position of said moon representation means with respect to said base that indicates a phase of the moon at a given time and marking a division of said continuous scale whereby the number of divisions of said continuous scale in a counterclockwise direction from said marker means to said moon representation means indicates the number of days before said phase will occur and the number of divisions of said continuous scale in a clockwise direction from said marker means to said moon representation means indicates the number of days after said phase last occurred; and a vernier scale fixedly attached to said base in a position adjacent to said continuous scale of said moon disk for measuring a fractional part of said division of said continuous scale marked by said marker means.

2. The moon clock of claim 1 wherein said vernier scale is fixedly attached to said base in a position adjacent to said continuous scale of said moon disk between a point adjacent to said continuous scale directly adjacent to said marker means and, in a counterclockwise direction therefrom, a point adjacent to said continuous scale 90 degrees from said point adjacent to said continuous scale directly adjacent to said marker means.

3. The moon clock of claim 2 further comprising a second vernier scale fixedly attached to said base in a position adjacent to said continuous scale of said moon disk for measuring a fractional part of said division of said continuous scale marked by said marker means, said second vernier scale being fixedly attached to said base in a position adjacent to said continuous scale between a point adjacent to said continous scale directly adjacent to said marker means and, in a clockwise direction therefrom, a point adjacent to said continuous scale 90 degrees from said point adjacent to said continuous scale directly adjacent to said marker means.

4. The moon clock of claim 1 wherein said vernier scale is fixedly attached to said base in a position adjacent to said continuous scale of said moon disk between a point adjacent to said continous scale directly adjacent to said marker means and, in a clockwise direction therefrom, a point adjacent to said continuous scale 90 degrees from said point adjacent to said continous scale directly adjacent to said marker means.

5. The moon clock of claim 4 further comprising a second vernier scale fixedly attached to said base in a position adjacent to said continuous scale of said moon disk for measuring a fractional part of said division of said continous scale marked by said marker means, said vernier scale being fixedly attached to said base in a position adjacent to said continuous scale between a point adjacent to said continous scale directly adjacent to said marker means and, in a counterclockwise direction therefrom, a point adjacent to said continous scale 90 degrees from said point of said continuous scale directly adjacent to said marker means.

6. The moon clock of claim 1 wherein said vernier scale comprises four equally spaced divisions and has a length equal to the length of five of said divisions of said continuous scale of said moon disk.

7. A nautical clock comprising:

a moon clock for indicating a phase of the moon, said moon clock comprising:

a base;

a moon disk attached to said base and rotatable about a central axis perpendicularly extending therefrom, said moon disk including:

a front surface;

moon representation means fixedly disposed on said surface for representing a moon; and a continuous graduated scale fixedly disposed on said surface adjacent to the periphery thereof, said continuous scale having a plurality of equally spaced divisions, each division representing one 24 hour day of a lunar month;

drive means attached to said base for rotating said disk about said axis in a clockwise direction at a rate corresponding to the rate of the lunar orbit;

marker means fixedly attached to said base in a position adjacent to said continuous scale of said moon disk for marking a position of said moon representation means with respect to said marker means that indicates a phase of the moon at a given time and marking a division of said continuous scale whereby the number of divisions of said continuous scale in a counterclockwise direction from said marker means to said moon representation means indicates the number of days before said phase will occur and the number of divisions of said continuous scale in a clockwise direction from said marker means to said moon representation means indicates the number of days after said phase last occurred; and a vernier scale fixedly attached to said base in a position adjacent to said continuous scale of said moon disk for measuring a fractional part of said division of said continuous scale marked by said marker means; and a tide clock for indicating a state of the tide, said tide clock comprising:

a base;

a tide disk attached to said base and rotatable about a central axis perpendicularly extending therefrom, said tide disk including:

a front surface; and tide representation means representing a high tide, said tide representation means comprising a flat circular member eccentrically disposed on said front surface in a fixed position such that the periphery of said circular member is contained within the periphery of said tide disk whereby the point on said front surface of the greatest distance between the periphery of said circular member and the periphery of said tide disk represents said high tide;

marker means fixedly attached to said base for marking a position of said tide representation means with respect to said base that indicates the time of said high tide; and drive means attached to said base for rotating said tide disk about said axis at a rate of approximately one revolution every 12 hours and 25 minutes.

8. The nautical clock of claim 7 further comprising a time clock for indicating the time of day.

9. The nautical clock of claim 8 wherein said time clock comprises:

a base;

hour indicator means attached to said base and rotatable about a central axis perpendicularly extending therefrom;

minute indicator means attached to said base and rotatable about said central axis; and drive means attached to said base for rotating said hour indicator means at a rate of one revolution every 12 hours and rotating said minute indicator means at a rate of one revolution every hour.

10. The nautical clock of claim 7 wherein said vernier scale of said moon clock is fixedly attached to said base of said moon clock in a position adjacent to said continuous scale of said moon disk between a point adjacent to said continuous scale directly adjacent to said marker means and, in a counterclockwise direction therefrom, a point adjacent to said continuous scale 90 degrees from said point adjacent to said continuous scale directly adjacent to said marker means.

11. The nautical clock of claim 10 wherein said moon clock further comprises a second vernier scale fixedly attached to said base of said moon clock in a position adjacent to said continuous scale of said moon disk for measuring a fractional part of said division of said continuous scale marked by said marker means, said second vernier scale being fixedly attached to said base of said moon clock in a position adjacent to said continuous scale between a point adjacent to said continous scale directly adjacent to said marker means and, in a clockwise direction therefrom, a point adjacent to said continuous scale 90 degrees from said point adjacent to said continuous scale directly adjacent to said marker means.

12. The nautical clock of claim 7 wherein said vernier of said moon clock is fixedly attached to said base of said moon clock in a position adjacent to said continuous scale of said moon disk between a point adjacent to said continous scale directly adjacent to said marker means and, in a clockwise direction therefrom, a point adjacent to said continuous scale 90 degrees from said point adjacent to said continous scale directly adjacent to said marker means.

13. The nautical clock of claim 7 wherein said vernier scale of said moon clock comprises four equally spaced divisions and has a length equal to the length of five of said divisions of said continuous scale of said moon disk.

14. The nautical clock of claim 7 wherein said tide representation means of said tide clock further comprise a mark representing said high tide disposed on said front surface of said tide disk between the center of said tide disk and the periphery thereof.

* * * * *